US007065948B2

(12) United States Patent
Kranich et al.

(10) Patent No.: US 7,065,948 B2
(45) Date of Patent: Jun. 27, 2006

(54) WEB TWISTER REMOVAL PROCESS

(75) Inventors: Martin Kranich, Wallhausen-Hengstfeld (DE); Oliver Lenz, Satteldorf (DE)

(73) Assignee: The Procter & Gamble Company, Cincinnati, OH (US)

( * ) Notice: Subject to any disclaimer, the term of this patent is extended or adjusted under 35 U.S.C. 154(b) by 287 days.

(21) Appl. No.: 10/739,490

(22) Filed: Dec. 18, 2003

(65) Prior Publication Data

US 2004/0129752 A1 Jul. 8, 2004

(30) Foreign Application Priority Data

Dec. 23, 2002 (EP) ..... 02028765

(51) Int. Cl.
*D02G 3/06* (2006.01)

(52) U.S. Cl. ..... 57/31; 57/264

(58) Field of Classification Search ..... 57/31, 57/260, 264, 265
See application file for complete search history.

(56) References Cited

U.S. PATENT DOCUMENTS

| | | | | |
|---|---|---|---|---|
| 1,178,566 | A * | 4/1916 | Wright | 242/128 |
| 1,333,147 | A * | 3/1920 | Wright | 242/128 |
| 3,537,252 | A * | 11/1970 | Gilmore et al. | 57/314 |
| 3,806,054 | A * | 4/1974 | Johnson et al. | 242/128 |
| 3,811,257 | A * | 5/1974 | Burr | 57/9 |
| 3,813,862 | A | 6/1974 | Tsuchida | |
| 5,592,849 | A * | 1/1997 | Nakade et al. | 73/160 |
| 5,666,704 | A * | 9/1997 | Price et al. | 26/74 |
| 5,918,353 | A * | 7/1999 | Jacumin | 26/71 |
| 6,735,933 | B1 * | 5/2004 | Abba et al. | 57/2.3 |

FOREIGN PATENT DOCUMENTS

| | | |
|---|---|---|
| DE | 3614327 A1 | 10/1987 |
| JP | 53119394 | 10/1978 |

* cited by examiner

*Primary Examiner*—Shaun R Hurley
(74) *Attorney, Agent, or Firm*—Keven C. Johnson; James E. Oehlenschlager; David M. Weirich

(57) ABSTRACT

An apparatus for detecting and eliminating a twister in a running web of flexible material. The apparatus includes a catch section for twisters, a rotor, a scanner arrangement for detection of a twister that has entered a catch section and a control unit , which, upon detection of a twister by the scanner, triggers the drive of the rotor for untwisting the twister.

9 Claims, 2 Drawing Sheets

WEB TWISTER REMOVAL PROCESS

FIELD OF THE INVENTION

The invention relates to an apparatus for detecting and eliminating a twister in a running web of flexible material.

BACKGROUND

As for the background of the invention, in the manufacture of sanitary articles such as diapers, napkins and pantyliners, various webs of nonwoven fabric and film are wound off supply rolls or bales and combined and united by way of corresponding web guides, with various working operations taking place on the way. Then detachment of individual pieces of the web takes place for configuration of the virtual product.

Problems posed in these manufacturing processes include the comparatively high velocities of the web of several meters per second and the great number of deflectors, conveying rollers and the like for the webs of strip material that frequently have only few centimeters of width. Conditioned by these circumstances, so-called twisters occur as the web winds off and flaps to and fro, in particular in the case of "festooned" supplies—which is a long web of material placed in loops one on top of the other. These twisters can proceed in the running direction via web guides such as deflection rollers, guide gaps etc. so that the twister will ultimately be found in the final product.

Problems arise from the fact that, mostly, at least some of the webs of a multilayer product have definitely allocated top and bottom sides. For example, the impermeable outer layers of diapers often have imprints suitable for children which a twister would turn upside down in the diaper. Another example is the punched cover film in pantyliners which also must be placed correctly during manufacture—i.e. with the projections from punching turned inwards.

A twister that has ultimately passed into the assembly operation of the individual webs will lead to a faulty waste product.

Another problem posed by twisters resides in that the web, where twisted, is exposed to increased strain by the twisting. Furthermore, web guide elements, such as guide gaps, offer some resistance when the twisters pass along, which means additional strain on the web. In this regard, twisters also cause an increase in web rupturing in the manufacturing plant, meaning standstill, downtime and renewed charging, which considerably affects manufacturing efficiency.

It is an object of the invention to embody an apparatus for detecting and eliminating a twister in a running web of flexible material.

SUMMARY

An apparatus with the following features is provided:

Provision is made for a twister catch section which extends between a guide gap on the inlet side and a guide gap on the outlet side;

a rotor houses the guide gap on the inlet side and is set in controlled rotary motion about an axis that is parallel to the web running direction;

a scanner and detection arrangement detects a twister that has entered the catch section; and upon detection of a twister by the scanner and detection arrangement, a control unit triggers the drive of the rotor so that the guide gap on the inlet side is rotated and the twister is eliminated.

"Catching" the twister along the catch section prevents it from migrating through the manufacturing plant and passing as far as to the operation of assembly. Furthermore, the fact that the twister remains within the catch section offers the possibility that it is recognized by corresponding detectors and that untwisting is initiated.

The scanner and detection arrangement preferably works on an optical basis, detecting web twisting by means of a light barrier, light curtain, camera, photoelectric detectors or the like.

If two scanner arrangements are disposed at a defined distance along the catch section, the number of twisters that have entered the catch section can be determined—as explained in detail in the exemplary embodiment. In doing so, it can be sufficient only to detect a deflection of the web without recording the extent to which it is deflected and to emit a correspondingly encoded, digital detection signal for further processing in the control unit. It is easily possible to differentiate between numbers ranging from no twister to as many as three twisters.

In keeping with another preferred embodiment, a detection arrangement for the existence of a twister is provided as an arrangement determining the way in which a twister is directed, so that untwisting takes place in the correct sense right from the beginning. By advantage, proximity sensors will detect the position of the side edges of the web in relation to the normal plane of running, which is also explained in detail below.

DETAILED DESCRIPTION

Figure 1:
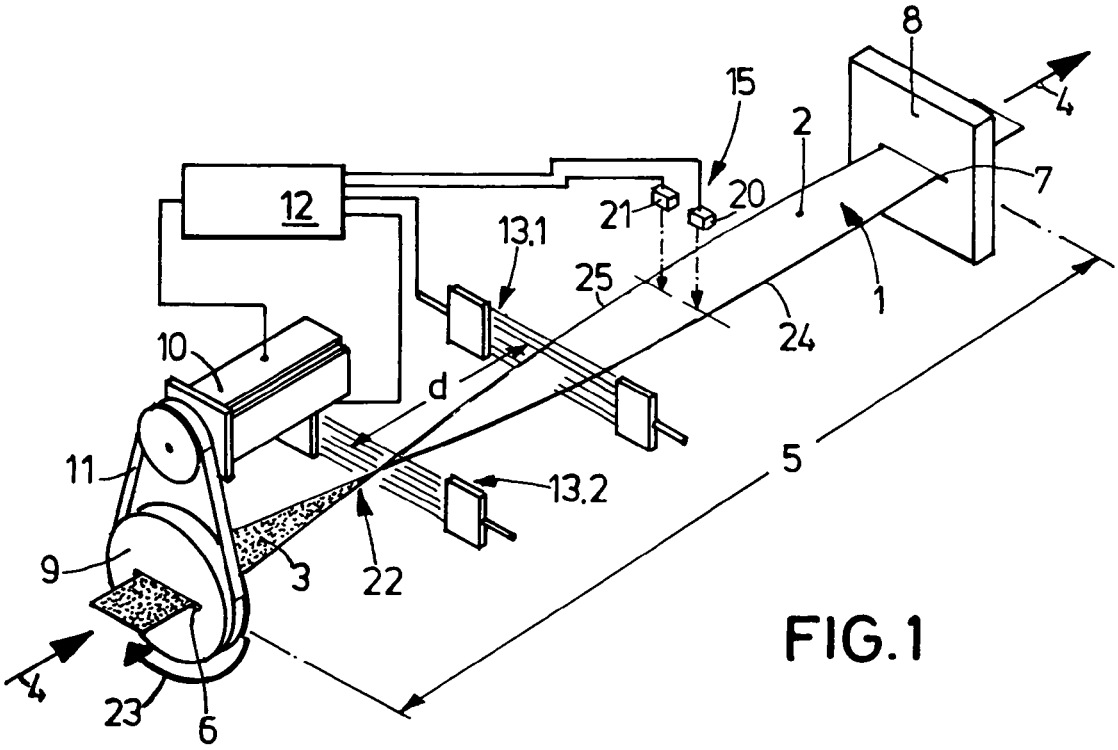
FIG. 1 is a perspective diagrammatic illustration of an apparatus for detecting and eliminating a twister.
Figure 2:
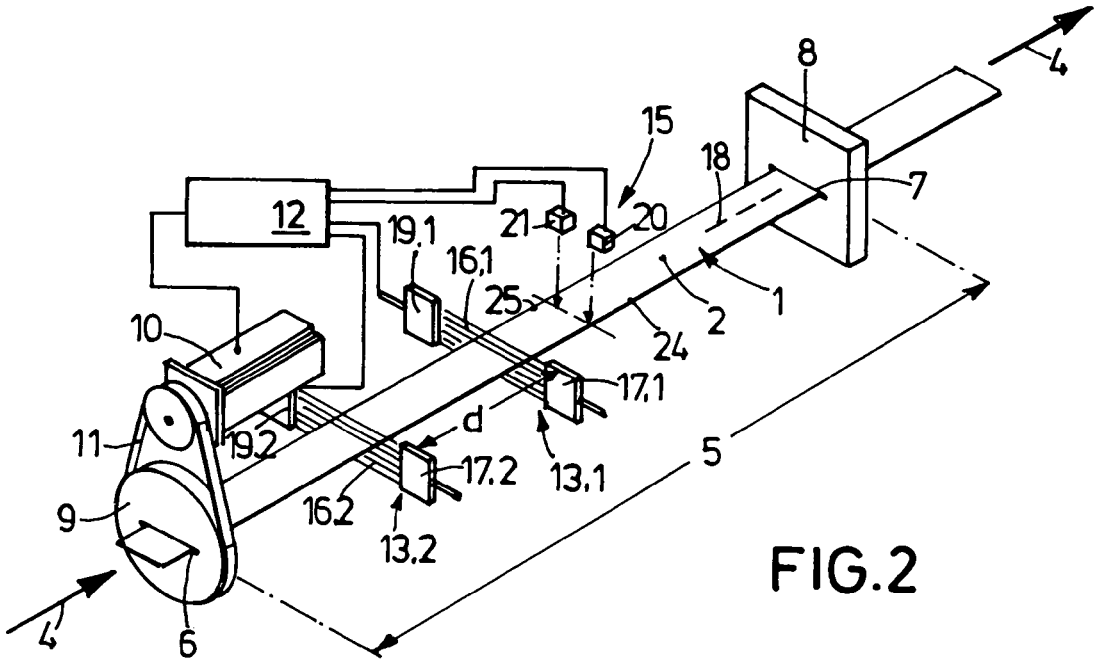
FIG. 2 is a perspective diagrammatic illustration of an apparatus for detecting and eliminating a twister.

FIGS. 1 and 2 illustrate the main components of an apparatus for the detection and elimination of twisters in a running web, hereinafter called anti-twister system. Any bearing and mounting elements for the components seen in these figures are omitted for reasons of clarity.

The two above-mentioned drawings show a web 1 of flexible material such as non-woven fabric. This web 1 has two different surfaces 2, 3, which is symbolized by light and dark coloring of the surfaces in FIGS. 1 and 3. The web 1 passes in the running direction 4 through a catch section 5, which is defined by a gap 6 on the inlet side—hereinafter called inlet gap—and a gap 7 on the outlet side—hereinafter called outlet gap. While the outlet gap 7 is incorporated stationarily in the anti-twister system, which is roughly outlined by the rectangular plate 8 that houses the gap 7, the inlet gap 6 is lodged in a rotor 9 that is mounted rotatably in the anti-twister system. Related to the width and thickness of the web 1, the inlet gap 6 is slightly longer and wider than the outlet gap 7 that seizes the web 1 comparatively closely. This makes it easy for twisters to enter the catch section 5, but slows down any migration of twisters from the catch section 5 in the running direction 4 at least until the anti-twister system has been set in action and eliminated the twister. In this regard, the anti-twister system efficiently and very reliably prevents twisters of the web 1 to pass as far as to the place of assembly with other webs, which would lead to waste products.

A stepper motor 10 is drivably coupled with the rotor by way of a timing belt 11 and triggered by a control unit 12. The control unit 12, by its signal inlets, is coupled with two scanners 13.1, 13.2, which are positioned along the catch section 5 and optically detect any twisting of the web 1 in a manner still to be explained, and with a detection arrangement 15 for determining how a twister is oriented.

Figure 3:
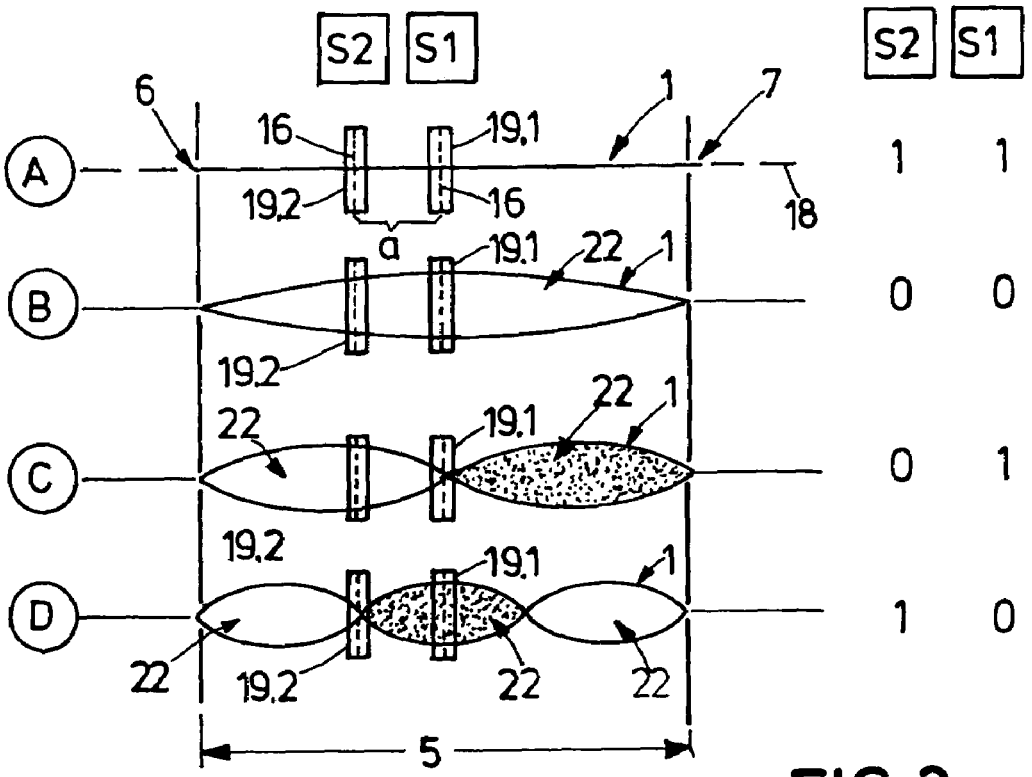
FIG. 3 is a diagrammatic graph illustrating the double scanner alimgement for determining the number of twisters along the catch section.
Figure 4:
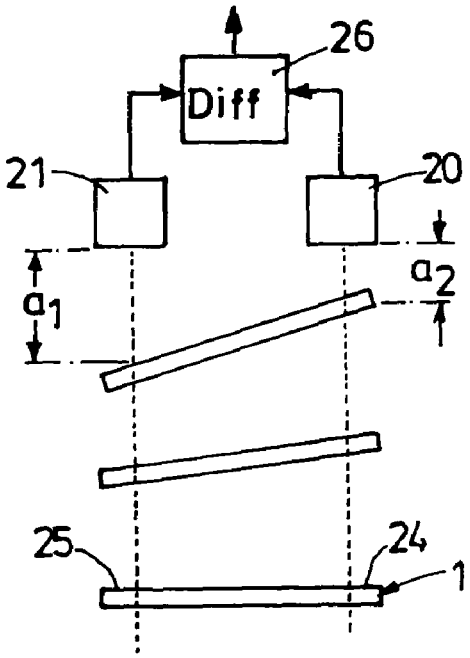
FIG. 4 is a diagrammatic illustration of the detection arrangement for determining how a twister is oriented.

The two scanners 13.1, 13.2 each comprise a so-called light curtain 16.1, 16.2 which is generated by a corresponding light source 17.1, 17.2 and directed vertically to the normal plane of running 18 (FIGS. 3 and 4). Opposing the light sources 17.1, 17.2 are corresponding light detectors 19.1, 19.2, quantitatively detecting the extent to which the light barrier 16.1, 16.2 is shaded over its width across the web 1.

The detection arrangement 15 comprises two proximity sensors 20, 21 which are disposed horizontally side by side crosswise of the running direction 4, and for which any form of distance sensing may fundamentally be used—for instance optical sensing by photoelectric cells, mechanical sensing by feelers, electrical sensing by capacitive or inductive sensors, but also ultrasonic and infrared proximity sensors.

The mode of operation of the scanners 13.1, 13.2 and the detection arrangement 15 is specified as follows, taken in conjunction with FIGS. 3 and 4:

The two scanners 13.1, 13.2 serve—as mentioned—for optically detecting the twisting of the web 1 and in particular also for determining the number of twisters. To this end, the scanner 13.1 is positioned—as seen in FIG. 3—centrally of the length of the catch section 5, and the scanner 13.2 is positioned upstream of the other scanner 13.1 at a distance of one sixth of the length of the catch section 5. If a twister 22 enters the catch section 5 through the inlet gap 6—as outlined in FIG. 1—it will set symmetrically to the length of the catch section 5 within a short period. In a lateral view—as outlined in FIG. 3—the contour of the web 1 twisted by 180° is an upright halfwave (see FIG. 3B).

If two twisters 22 have entered the catch section 4, the contour, in a side view, of the web 1 twisted by 360° is an upright wave (see FIG. 3C) with two wave loops and a central wave node. If there is another twister 22—i.e. the web 1 twisted by 540°—the appearance is that of one and a half upright wave (see FIG. 3D) with three wave loops and two nodes along the catch section 5.

The above characteristic of the web 1 in its various twisted contours is used for determining the existence and number of twisters 22. An untroubled web 1 (see FIG. 3A) will run properly horizontally, virtually not interfering with the light curtains 16.1, 16.2. Both light detectors 19.1, 19.2 of the scanners 13.1, 13.2 have a high signal level S1=1 and S2=2.

If a twister 22 arrives, both light detectors 19.1, 19.2 are covered by the contour of the twisted web 1 because of their substantially central position relative to the catch section 5; both signals of the light detectors 19.1, 19.2 are set to zero: S1=0 and S2=0.

In the case of two twisters 22, the central scanner 13.1 is in the vicinity of the node so that the corresponding light detector 19.1 is virtually not shaded, whereas the light detector 19.2 of the off-center scanner 13.2 is shaded by the wave loop arriving there. This gives the signal combination S1=1 and S2=0 for two twisters.

In the case of three twisters 22, the central light detector 19.1 of the scanner 13.1 is shaded by the central wave loop, whereas the off-center light detector 19.2 of the scanner 13.2 is in the vicinity of a wave node. This gives a signal combination S1=0 and S2=1 for three twisters.

As becomes apparent from the above explanations, the conditions of no twister/a single twister/two twisters/three twisters are distinctly digitally encoded by the signal combination S1-S2. This detection signal can conventionally be used by the control unit 12 for triggering the rotor 9.

Independently of the detection arrangement 15, the control unit 12, after determination of a twister within the catch section 5, can rotate the rotor 9 by 180° for example in the direction of rotation 23 seen in FIG. 1, which is noticeably the "wrong" direction in the case shown. Then the scanners 13 will recognize two twisters along the catch section 5 instead of one. This means that this was the wrong direction of rotation 23 and that the web 1 must be rotated twice by 180° in the opposite direction. After this operation, the twister 22 is eliminated from the catch section 5.

In order to enable twisters to be eliminated as rapidly as possible and without any faulty rotation, provision is made for the detection arrangement 15, which can be used for recognition of twisters fundamentally without the scanners 13.1, 13.2. By its proximity sensors 20, 21, this detection arrangement 15 detects the position of the two opposite lateral edges 24, 25 of the web for corresponding distance sensing. The signals of the proximity sensors 20, 21 that represent the distance are compared by a differentiator 26 in the control unit 12. In the case of a horizontal web 1 that runs properly, the two distances $a_1$, $a_2$ between the lateral edges 24, 25 and the proximity sensors 20, 21 are equal so that no action of the rotor 9 is needed—which is confirmed by the scanners 13 if available. As soon as a single twister 22 or several twisters 2 arrive within the catch section 5, the web 1 tilts due to its being twisted so that the proximity sensors 20, 21 measure different distances. Depending on whether the distance is smaller on one side or the other, the direction of the twisting can be clearly determined and the correct direction of rotation and correct number of rotations of the rotor 9 by 180° can be determined, possibly by logical linkage to the signal of the scanners 13. Without the scanners 13, when a twister is detected by different distances $a_1$, $a_2$ of the lateral edges 24, 25 being measured, rotation of the rotor 9 will simply be initiated via the control unit 12 until the two distances $a_1$, $a_2$ are measured to be equal.

What is claimed is:

1. An apparatus for detecting and eliminating a twister in a running web of flexible material in the manufacture of sanitary articles, comprising a catch section for twisters, which extends between a web guide gap on the inlet side and a web guide gap on the outlet side;

a rotor, which is controlled in rotation about an axis parallel to the web running direction and which houses the web guide gap on the inlet side;

a scanner and detection arrangement for detecting a twister that has entered the catch section; and a control unit, which, upon detection of a twister by the scanner arrangement, triggers the drive of the rotor for rotation of the web guide gap on the inlet side and thus for untwisting the twister, wherein the scanner and detection arrangement is an optical scanner arrangement comprising at least two scanners which determines any twisting of the web out of the normal plane of running.

2. The apparatus according to claim 1, wherein the optical scanner arrangement includes a light barrier, a light curtain, a camera or photoelectric detectors.

3. The apparatus according to claim 1, wherein the at least two scanners are positioned at a defined distance (d) along the catch section for determining the number of twisters that have entered the catch section.

4. The apparatus according to claim 3, wherein the distance (d) corresponds to one sixth of the length of the catch section.

5. The apparatus according to claim 3, wherein the two scanners detect the deflection of the web and emit a digitally encoded detection sigmal for further processing in the control unit.

6. The apparatus according to claim 1, wherein a detection arrangement is provided as am arrangement that determines how a twister is directed.

7. The apparatus according to claim 6, wherein the detection arrangement comprises at least a proximity sensor that detects the position of the lateral edge of the web relative to the normal plane of running.

8. The apparatus according to claim 7, wherein two proximity sensors, in a joint position lengthwise of the web, are respectively allocated to one of the opposite lateral edges of the web.

9. The apparatus according to claim 1, wherein the web guide gap on the inlet side guides the web by greater play than the web guide gap on the outlet side.

* * * * *

UNITED STATES PATENT AND TRADEMARK OFFICE

CERTIFICATE OF CORRECTION

PATENT NO. : 7,065,948 B2
APPLICATION NO. : 10/739490
DATED : June 27, 2006
INVENTOR(S) : Kranich et al.

It is certified that error appears in the above-identified patent and that said Letters Patent is hereby corrected as shown below:

Column 5, line 16, “sigmal” should read --signal--.

Column 6, line 2, “am” should read --an--.

Signed and Sealed this

First Day of May, 2007

JON W. DUDAS
*Director of the United States Patent and Trademark Office*